United States Patent [19]

Echols et al.

[11] 3,946,455

[45] Mar. 30, 1976

[54] CLEANING DEVICE FOR TUBES

[76] Inventors: Marvin Echols, 12021 Winwood, Houston, Tex. 77024; Ralph H. Stockton, 4900 Palmetto St., Bellaire, Tex. 77401

[22] Filed: May 15, 1974

[21] Appl. No.: 470,265

[52] U.S. Cl. ..... 15/104.06 R
[51] Int. Cl.[2] ..... B08B 9/04
[58] Field of Search ..... 15/3.5, 3.51, 104.06 R, 15/104.06 A

[56] References Cited

UNITED STATES PATENTS

| | | | |
|---|---|---|---|
| 1,547,440 | 7/1925 | Penn | 15/104.06 R |
| 2,188,959 | 2/1940 | Schaer | 15/104.06 R |
| 3,857,132 | 12/1974 | Knapp et al. | 15/104.06 R |

*Primary Examiner*—Edward L. Roberts
*Attorney, Agent, or Firm*—Bertram H. Mann

[57] ABSTRACT

A cleaning device for heat exchanger tubes comprising a rubbing body consisting of a hollow casing member of elastomeric material with diametrical openings, and an encased check ball. A thickened band extends intermediately around the casing member for rubbing against the tube wall and is provided with slots enhancing the flexibility of the band. The overall density of the device approximates that of the liquid with which it is to be used.

2 Claims, 5 Drawing Figures

CLEANING DEVICE FOR TUBES

BACKGROUND OF THE INVENTION

Heat exchanger tube cleaning bodies consisting of balls of sponge rubber which may or may not have abrasive surface treatment, are known in the prior art. These balls are inserted into the liquid which circulates through the exchanger tubes, for instance, in the condenser or first stage cooler of an air conditioning system, for rubbing against and thereby cleaning the tube inner walls of the tubes. However, these devices, being of relative soft material, soon wear to an ovoid shape such as to reduce their cleaning effect and must be replaced after a relatively short period of use. Also, these devices do not uniformly clean the tubes of a horizontally arranged tube bundle, for instance, in a system utilizing water for cooling or heating, since they, after absorbing the carrier liquid, are not of a density equivalent to that of the circulating liquid so that they tend to float or sink in the headers connecting the tubes of a tube bank. Accordingly, there is inadequate cleaning of the tubes at the bottom or top of the bundle. Finally, such prior art devices do not incorporate any self-orienting feature, which would be unimportant when the devices are new and spherical, and provide no means for enhancing the scrubbing engagement of the device with the tube wall, after the device becomes worn.

SUMMARY OF THE PRESENT INVENTION

Accordingly, an object of the present invention is to provide a cleaning device for heat exchanger tubes which has a much longer useful life than devices for a similar purpose heretofore in use.

Another object is to provide such a device which will easily enter the tubes of a bundle from a header at the end of the bundle and which will be self-orienting when inserted in a tube.

Another object is to provide a self-orienting tube cleaning device having rubbing surfacing more resistant to wear than previous devices yet sufficiently flexible to enter and move along the tubes with the circulating fluid.

These objects and others hereafter appearing are attained by the herein-described device which comprises a hollow casing member of elastomeric material, for instance, synthetic or natural rubber, having diametrical holes forming opposed valve seats. A check ball, conveniently of polypropylene, is movably received between the seats. Intermediately surrounding the casing member is a cleaning band in which there are provided annularly spaced slots. The material of the band is more wear resistant and, in a preferred embodiment, somewhat stiffer than the end portions of the casing, but the slots assure adequate flexibility to permit the casing to readily enter the tubes. When inserted within a tube the device moves along with the liquid therein and the differential pressure thereacross causes the check ball to seat at the front end of the casing member so as to cause the wear band to rub uniformly against the tube wall. The higher fluid pressure in back of the device presses the cleaning band outwardly against the tube wall so as to maintain efficient cleaning contact therewith over a long period of time, notwithstanding wear at the surface of the band. The assembled device is of substantially the same density as the liquid with which it is used so as to move with the liquid current in the headers and, thereby, by random selection over a certain period of time, insure uniform passage through the tubes of a bundle.

BRIEF DESCRIPTION OF THE DRAWINGS

In the accompanying drawings which illustrate the invention.

DETAILED DESCRIPTION OF AN EXEMPLARY EMBODIMENT

Figure 1:
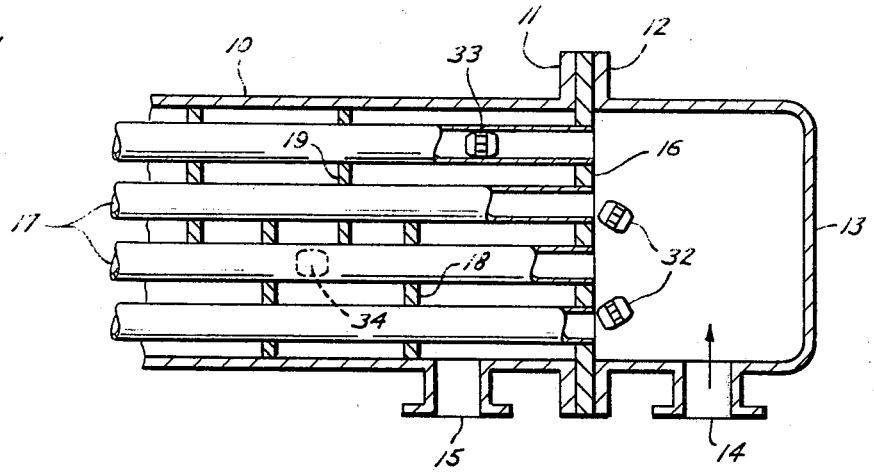
FIG. 1 is a vertical longitudinal section through a portion of a horizontally disposed heat exchanger.
Figure 2:
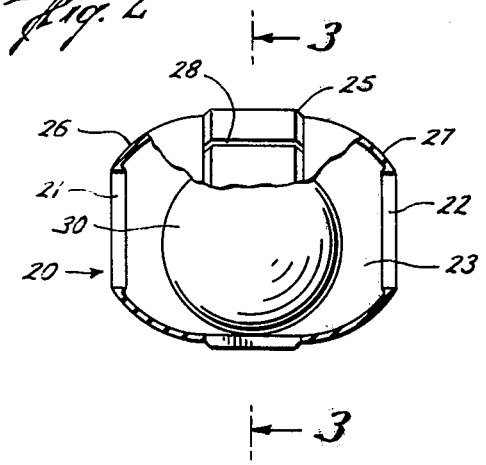
FIG. 2 is a side view and longitudinal section of the novel cleaning device.
Figure 3:
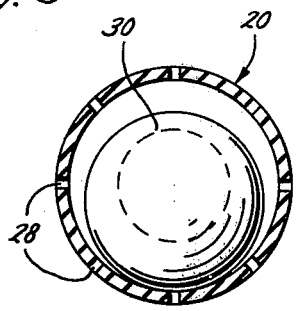
FIG. 3 is a transverse cross section taken on line 3—3 of FIG. 1.

FIG. 1 illustrates a portion of a horizontally oriented shell and tube type heat exchanger, including a cylindrical casing 10 having an end flange 11 bolted in the usual manner to the flange 12 of a header 13. Flanged nipples 14 and 15 constitute liquid tube and shell fluid connections, others (not shown) being provided as required. A tube sheet 16 is secured between flanges 11 and 12 and traverses the end of casing shell 10. A multiplicity of tubes 16, forming a tube bundle, extend longitudinally through shell 10 and are secured at their ends in and open through tube sheet 16. Baffles as at 18 and 19, cause the shell fluid to follow a serpentine path through shell 10.

The novel cleaning device, generally designated 32, comprises a hollow casing member 20, in this instance of ovoid shape, with end openings 21 and 22 forming with the hollow interior 23 a passage extending longitudinally through the casing member. The casing member, conveniently and satisfactorily, is formed of synthetic rubber. Extending centrally around the casing member is a wear band 25 which is somewhat thicker than the curved end portions 26 and 27 so that the material of the band is stiffer than the end portions. To compensate for such added stiffness the band is provided with circumferentially arranged slots 28. The wear resistance of the band as well as its cleaning and polishing properties may be enhanced by frictional material applied thereto or incorporated therein, for instance, carbon black conventionally incorporated in rubber.

Received within the hollow interior of the casing member is a check ball 30 which is somewhat larger in diameter than the end openings 21 and 22 of the casing member so as to seat against the peripheries of these openings which, in effect, form internal shoulders or valve seats at the ends of the passage through the casing member. Yet the ball can be readily inserted in the casing member by stretching one or the other of these peripheries. The check ball, in an embodiment intended for use in water, may be made of polypropylene plastic having a specific gravity of approximately 0.90. The casing member, being of natural rubber or synthetic rubber compound, then, should have a buoyancy compensating specific gravity of approximately 1.2 or so that the overall density of the assemble device is approximately 1. The purpose of this feature is to cause the tube heat exchange fluid, in circulating through header 13, to carry with it the cleaner device or devices.

OPERATION

A multiplicity of the rubbing bodies 32 will be inserted in the tubing fluid stream for circulation through tubes 17 and header or headers 13 at the ends of the tube bundles. Where the heat exchanger has hundreds or even thousands of individual tubes, as is frequently the case, we have found that the provision of about one-twentieth as many of the devices as there are tubes will result in exemplary cleaning action. Assuming that the liquid and rubbing bodies enter heater 13 through the connection 14, the bodies will rise in the header, with the liquid current, as indicated in FIG. 1. Where a particular tube has already received a rubbing body, as at 33 or 34, the fluid flow through other tubes, necessarily, will be faster and the tendency of rubbing bodies in the header will be to enter such other tubes. Thus, there results a random selection whereby, over a certain period of time, all of the tubes will receive a substantially equal number of passes of the rubbing bodies. Such uniform action results, in a large measure, from careful selection of the materials of the rubbing bodies so that the composite density of the devices closely approximates the density of the liquid with which the bodies are to be used and are being used.

Figure 4:
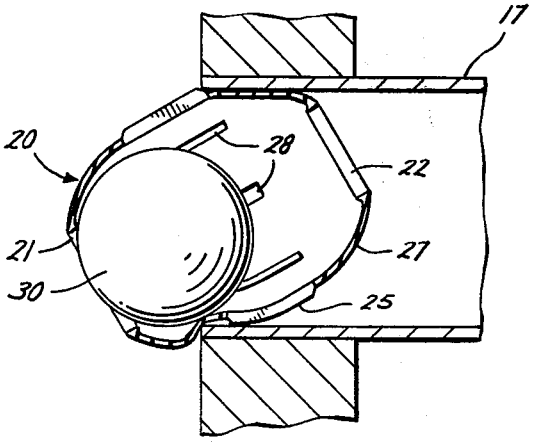
FIG. 4 is a more or less schematic view showing a novel cleaning device entering a heat exchanger tube from a position disaligned with the tube.
Figure 5:
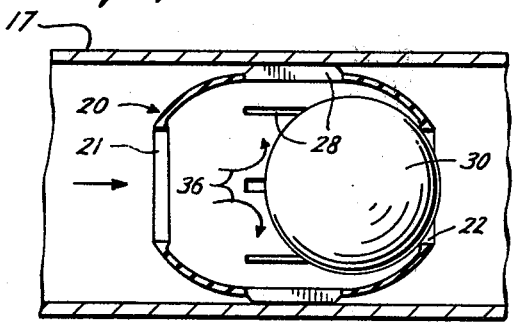
FIG. 5 is a cross-sectional view of the device cleaning position within a heat exchanger tube.

In case one of the bodies approaches the mouth of a tube, with the device disaligned with respect to the tube at an acute angle thereto (FIG. 4) as will usually be the case, the pliable end portion 26 or 27 will easily distort to permit initial entry into the tube. When a position obstructing the tube opening is reached, as in FIG. 4, ball 30 will be impelled fowardly to seat against the periphery of forward opening 22. Of course, the body may enter a tube with either end forward. Thereupon, the differential across the body will be increased and the body will be rapidly pushed into and in alignment with the tube, as in FIG. 5. The body then will pass through the tube with its intermediate wear band 25 in rubbing engagement with the inner surface of the tube. Since the outer diameter of the casing member and particularly the band 25 thereof will be somewhat greater than the I.D. of the tube, this band will be somewhat compressed, when in cleaning position, the slots 28 assisting in such compressive action. However, the slots 28 may continue to remain open far enough to provide for bypassing of some of the upstream liquid past the check ball for agitating the liquid immediately downstream of the body.

Of special significance in connection with the operation of the novel cleaner device or body is the fact that the upstream fluid pressure bears not only against the back of the check ball, but radially outwardly against cleaner band 25, as indicated by the arrows 36. This insures the exertion of substantial outward pressure by the device upon the tubing wall, due to a fluid pressure as well as the resilience of band 25, with resultant effective cleaning and polishing action over a long period of time, even after some wear has occurred on the outer surface of the rubbing band 25. For further enhancing this cleaning action, the material of the casing member, and more particularly the surface of band 25, may be provided with applied or incorporated carbon black, a very hard but fine abrasive substance, or other abrasive material. However, the rubber, itself, has superior frictional properties.

Accordingly, we have provided a cleaning device for heat exchanger tubes which will operate effectively over much longer periods of time than prior art devices. This is particularly important in connection with heat exchangers, as illustrated, for instance, in FIG. 1, in which the most fouling fluid customarily is directed through the tubes, which are easier to clean than the shell due to obstructions such as the baffles 18 and 19 in the latter. The devices may continuously operate without change or disturbance for many months, whereas available prior art devices, customarily, have required replacement within a matter of a few weeks, and even during part of this period have produced inefficient cleaning due to wear and the nonuniform distribution of the cleaners among the tubes. For the latter reason, these prior art devices are not very effective when used with horizontal tube bundles. While the device has been used effectively with water tubes, it may be used with tubes carrying other liquids by adjusting the density of the device in accordance with the density of the particular liquid contemplated. Of particular advantage is the possibility of constructing the casing, and particularly, the wear band 25 of material best adapted to serve the tube cleaning and/or polishing function, while the check valve is constructed of material of the proper density so that the composite specific gravity of the device approximates that of its carrier fluid. Moreover, the making of the device of impervious material permits accurate adjustment of its buoyancy in the carrier fluid and, of course, avoids the absorption of the fluid by the rubbing body as occurs with the sponge bodies of the prior art, causing them to tend to sink. The device may be outwardly spherical, rather than ovoid as shown, but in cross section should match the shape of the tubing for which it is intended, while being somewhat larger to insure cleaning and polishing action against the tube walls. Various features may be modified as will occur to those skilled in the art, and the exclusive use of all modifications as come within the scope of the appended claims is contemplated.

We claim:

1. A cleaner device for heat exchanger tubes and the like comprising a casing member with a generally cylindrical outer wall and of yielding material and having a passage extending therethrough with spaced internal shoulders at an end of said passage forming a valve chamber and a check valve in said chamber, the terminal portions of said wall being more pliable than intermediate portions thereof to facilitate entry of the device into a tube when the device is oriented at an acute angle in relation to the mouth of a tube.

2. A cleaner device for heat exchanger tubes and the like comprising a casing member of yielding material and circular cross section and having a passage extending therethrough with spaced, internal valve seat forming shoulders, a check valve between said shoulders, said casing member having an external intermediate band adapted for rubbing against an encompassing tube wall, said band being expansible by internal fluid pressure to enhance its cleaning engagement with the tube walls, there being annularly spaced longitudinal slots in said band to facilitate circumferential compression and expansion thereof.

* * * * *